US006089009A

United States Patent [19]

Hand et al.

[11] Patent Number: 6,089,009

[45] Date of Patent: Jul. 18, 2000

[54] FLUID-JET FALSE-TWISTING METHOD AND PRODUCT

[75] Inventors: Edward Lowe Hand, deceased, late of Belmont, by Gail F. Hand, legal representative; Kurt Willy Niederer, Charlotte, both of N.C.; Robert Edward Taylor, Columbia, S.C.; Ralph Samuel Jenkins, Gastonia; Jeffrey Todd Rhyne, Belmont, both of N.C.

[73] Assignee: Belmont Textile Machinery Co., Inc., Mt. Holly, N.C.

[21] Appl. No.: 09/058,010

[22] Filed: Apr. 9, 1998

Related U.S. Application Data

[60] Provisional application No. 60/057,152, Aug. 28, 1997.

[51] Int. Cl.[7] ..... D01H 13/26

[52] U.S. Cl. ..... 57/282; 57/284; 57/289; 57/293; 57/332; 57/333; 57/350; 57/908

[58] Field of Search ..... 57/282, 284, 289, 57/293, 332, 333, 350, 908, 304, 305, 294

[56] References Cited

U.S. PATENT DOCUMENTS

| | | |
|---|---|---|
| 2,990,671 | 7/1961 | Bunting, Jr. et al. . |
| 3,744,232 | 7/1973 | Shah . |
| 3,775,955 | 12/1973 | Shah . |
| 4,002,012 | 1/1977 | Norris et al. . |
| 4,051,660 | 10/1977 | Griset, Jr. ..... 57/140 |
| 4,074,511 | 2/1978 | Chambley et al. . |
| 4,083,172 | 4/1978 | Norris et al. . |
| 4,104,855 | 8/1978 | Chambley et al. . |
| 4,114,549 | 9/1978 | Chambley et al. . |
| 4,123,893 | 11/1978 | Chambley et al. . |
| 4,142,355 | 3/1979 | Chambley et al. . |
| 4,170,103 | 10/1979 | Norris et al. . |
| 4,170,868 | 10/1979 | Chambley et al. . |
| 4,173,115 | 11/1979 | Chambley et al. . |
| 4,173,861 | 11/1979 | Norris et al. . |
| 4,186,549 | 2/1980 | Chambley . |
| 4,215,642 | 8/1980 | Chambley et al. . |
| 4,246,750 | 1/1981 | Norris et al. . |
| 4,276,740 | 7/1981 | Chambley et al. . |
| 4,279,120 | 7/1981 | Norris . |
| 4,873,821 | 10/1989 | Hallam et al. . |
| 4,934,134 | 6/1990 | Niederer . |
| 5,003,763 | 4/1991 | Hallam et al. . |
| 5,012,636 | 5/1991 | Hallam et al. . |
| 5,056,200 | 10/1991 | Schwartz et al. . |
| 5,134,840 | 8/1992 | Niederer et al. . |
| 5,179,827 | 1/1993 | Tinsley et al. . |
| 5,228,282 | 7/1993 | Tinsley et al. . |
| 5,465,566 | 11/1995 | Edwards et al. . |
| 5,557,915 | 9/1996 | Knoff et al. . |
| 5,577,376 | 11/1996 | McAllister et al. . |
| 5,598,694 | 2/1997 | Edwards et al. . |
| 5,619,849 | 4/1997 | McNeill . |

*Primary Examiner*—William Stryjewski
*Assistant Examiner*—Gina Silverio
*Attorney, Agent, or Firm*—Adams Law Firm, P.A.

[57] ABSTRACT

A process of producing an assembled yarn, including the steps of providing two or more yarns moving downstream from a supply to a take-up, inserting alternating-direction zones of twist into at least one of the yarns, the at least one yarn having an area of zero twist between said alternating direction zones of twist, combining the at least two yarns to form a single, integrated yarn strand, and intermittently exposing the yarn strand to an air blast to create a zone of intermingled yarns at spaced-apart points along the length of the yarn strand to prevent torsional movement of one yarn relative to the other yarn. According to one preferred embodiment of the invention, the step of exposing the yarn strand to an air blast includes the step of intermingling the yarns at the areas of zero twist.

12 Claims, 16 Drawing Sheets

FLUID-JET FALSE-TWISTING METHOD AND PRODUCT

CLAIM OF BENEFIT OF EARLIER-FILED PROVISIONAL APPLICATION

This application claims the benefit of an earlier-filed provisional application entitled "Fluid-Jet False-Twisting Apparatus, Method and Product", filed on Aug. 28, 1997, Ser. No. 60/057,152.

TECHNICAL FIELD AND BACKGROUND OF THE INVENTION

This invention relates to a method for twisting individual strands of yarn and plying these individually twisted strands around each other, and the yarn made according to the method. More specifically, this twisting action is accomplished by false-twisting, where for a certain yarn length the yarn is twisted a number of turns in one direction and then for another sequential length, it is twisted in the opposite direction. The application also discloses yarns produced according to the method and on an apparatus of the type described.

The nature of false twisting is such that the total number of turns in one direction minus the total number of turns in the opposite direction over the total yarn-length is zero. The method of taking several twisted yarns and combining them by twisting them together to make a multi-stranded yarn has been known for thousands of years. However, plying previously-twisted yarns together is energy and time-consuming, since for every turn in the individual yarn and also for every turn in the plied multi-stranded yarn, the yarn packages must be turned around their axis.

The apparatus and method according to the invention is much more economical since only a relatively short piece of each yarn is twisted around its own axis. The secondary plying occurs automatically since, through the inserted torque, the twisted yarns in the single yarn twist around each other in the direction of the yarn-torque.

The false-twist process requires that care be taken to insure that the false-twisted multi-stranded yarn does not untwist at the place of twist-reversal. This is normally accomplished by attaching fibers of a single yarn to fibers of another, adjoining yarn. Various means of interlocking of these yarns at the twist reversal places have been used, for example, intermingling the fibers through abrasion, ultrasonic bonding, intermingling the fibers with an air-jet directing high-pressure air onto the traveling yarn, for example.

SUMMARY OF THE INVENTION

It is therefore an object of the invention to provide a multi-stranded, plied yarn by twisting a section of a given length of each individual strand around its own axis where the downstream sides of the yarns have twist in one direction and the upstream sides have the same amount of opposite twist. The twist direction is alternated periodically, whereby at twist reversal locations the fibers of the individual yarns are "tacked" by a fluid jet, such as an air-jet, the orifice of which moves substantially in unison direction and velocity with the traveling yarn, thus intermingling the fibers of the yarn effectively and over a relatively short distance.

It is another object of the invention to apply the twist to the individual yarns with stationary twisting elements as the yarns travel past the stationary twisting elements, whereby the direction of twist is periodically reversed.

It is yet another object of the invention to provide a rotating fluid-jet, wherein the timing of the activation of the jet coincides with the desired point of reversal of twist in the traveling yarn.

It is another object of the invention to control the insertion of twist by means of compressed air supplied by twist-inserting air-jets connected to solenoid valves, which are controlled through an electronic controller.

It is another object of the invention to provide a false-twist apparatus wherein compressed air to the twist-inserting jets through solenoid-valves which are controlled through an electronic controller with an electronic input and output where the input is received from the position of the traveling interlacing jet and the output controls the solenoid valves of the twist-inserting air-jets.

It is another object of the invention to provide a false-twist apparatus wherein the intermingling air-jet is placed off-center in the intermingling chamber, generating a partially rotating, intermingling air-stream in one direction where the direction of the rotation augments the self-wrapping of the yarn-strands.

It is another object of the invention to provide that two intermingling air-jets are employed which are placed off-center in opposite directions, each one to augment the self-wrapping of the yarn-strands in both direction.

It is another object of the invention to provide that the twist reversal of each yarn is controlled individually with the result that the twist reversal of one or more yarns is at a different location from the others along the plied yarn.

It is another object of the invention to provide that one or more yarns are not twisted for a given period of time or may never be twisted at all.

It is another object of the invention to provide that one or more yarns are twisted in opposite directions to another yarn in the plied yarn.

It is another object of the invention to provide that the amount of twist in one or more yarns are varied over the length of the plied yarn.

It is another object of the invention to control the rotational speed of a rotating air-jet in such a manner that the entangling jet moves approximately with the yarn process speed and is placed in such a manner that air is directed against the yarn at the point of twist-reversal of the yarn.

It is another object of the invention to control the rotational speed of a rotating air-jet and of the twisting jets during the operation in order to vary the distance between the places of twist reversal to prevent possible "moireé-effects" in the final product.

It is another object of the invention to control the rotational speed of a rotating air-jet and the timing of the twisting jets during the operation in order to vary the distance between two successive, adjacent points of twist reversal to prevent possible "moiré-effects" in the final product.

These and other objects of the present invention are achieved in the preferred embodiments disclosed below by providing a process of producing an assembled yarn, comprising the steps of providing two or more yarns moving downstream from a supply to a take-up, inserting alternating-direction zones of twist into at least one of the yarns, said at least one yarn having an area of zero twist between said alternating direction zones of twist, combining the at least two yarns to form a single, integrated yarn strand, and intermittently exposing the yarn strand to an air blast to create a zone of intermingled yarns at spaced-apart points along the length of the yarn strand to prevent torsional movement of one yarn relative to the other yarn.

According to one preferred embodiment of the invention, the step of exposing the yarn strand to an air blast includes the step of intermingling the yarns at the areas of zero twist.

According to another preferred embodiment of the invention, the step of exposing the yarn to an air blast includes the steps of intermingling the yarns at the areas of zero twist, and intermingling the yarns at spaced-apart points along the length of the yarn strand other than at the areas of zero twist.

According to yet another preferred embodiment of the invention, the step of exposing the yarn to an air blast includes the step of intermingling the yarns at random points along the length of the yarn strand.

According to yet another preferred embodiment of the invention, the step of exposing the yarn to an air blast includes the step of intermingling the yarns at predetermined points along the length of the yarn strand.

According to yet another preferred embodiment of the invention, the step of exposing the yarn to an air blast includes the steps of intermingling the yarns at random points along the length of the yarn strand, and intermingling the yarns at predetermined points along the length of the yarn strand.

According to yet another preferred embodiment of the invention, the step of inserting alternating-direction zones of twist into at least one of the yarns comprises applying an air blast induced torque to said yarn.

According to yet another preferred embodiment of the invention, the step of intermittently exposing the yarn strand to an air blast includes the step of moving the air blast along the direction of travel of the yarn strand as the yarns are intermingled to thereby reduce the length of the zone of intermingled yarns.

According to yet another preferred embodiment of the invention, the step of moving the air blast includes the step of moving the air blast at a linear speed equal to the linear speed of travel of the yarn strand.

According to yet another preferred embodiment of the invention, the step of moving the air blast includes the step of moving the air blast at a linear speed not equal to the linear speed of travel of the yarn strand.

According to yet another preferred embodiment of the invention, the step of inserting alternating-direction zones of twist into at least one of the yarns comprising the step of inserting more turns of twist per unit length of yarn in one direction than in the other direction.

According to yet another preferred embodiment of the invention, the step of inserting alternating-direction zones of twist comprises the step of inserting alternating zones of "Z twist, "S" twist and zero twist.

According to yet another preferred embodiment of the invention, the step of inserting alternating-direction zones of twist comprises the step of changing the direction of twist in fewer than all the yarns at a given time.

According to yet another preferred embodiment of the invention, the process includes the step of delaying or advancing the step of inserting alternating-direction zones of twist into at least one of the yarns relative to the step of intermittently exposing the yarn strand to an air blast to create a zone of intermingled yarns at spaced-apart points along the length of the yarn strand.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
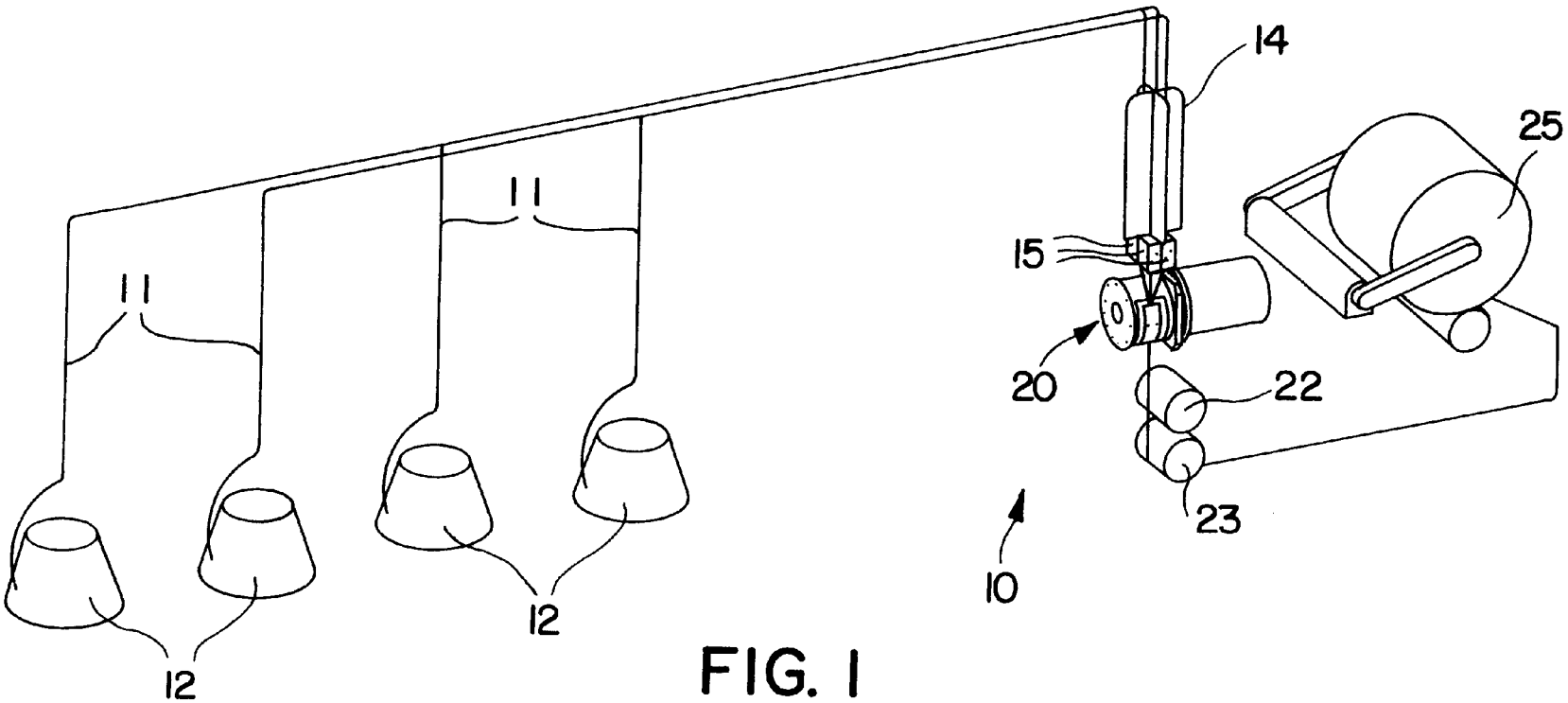
FIG. 1 is a simplified, schematic, perspective view of a fluid-jet false-twisting apparatus according to an embodiment of the present invention.

Referring now specifically to the drawings, a fluid-jet false-twisting apparatus is shown schematically in FIG. 1 and generally indicated at broad reference numeral 10. In general, multi-filament yarns 11 are taken from respective supply packages 12 and passed through a yarn separator 14, four twist-inserting air-jets, referred to as "twister blocks 15" (one for each yarn 11) and a rotary air jet assembly 20, where the yarn 11 is plied by the combined action of the twister blocks 15 and the rotary air jet assembly 20 in the manner according to the invention as described in this application. Air is supplied to the twister blocks 15 from a source of pressurized air by means of solenoid valves controlled by mechanical, electromechanical or, preferably, electronic means (not shown). The length of the yarn upstream of the twister blocks 15 can be less than twice the distance between each twist reversal, and in some applications as low as one-to-one, a substantial advantage over prior art processes.

The yarns 11, now in plied form, are guided around overfeed drive rolls 22, 23 where the tension on the plied yarns 11 is reduced to a predetermined extent before delivery to a take-up package 25.

Figure 2:
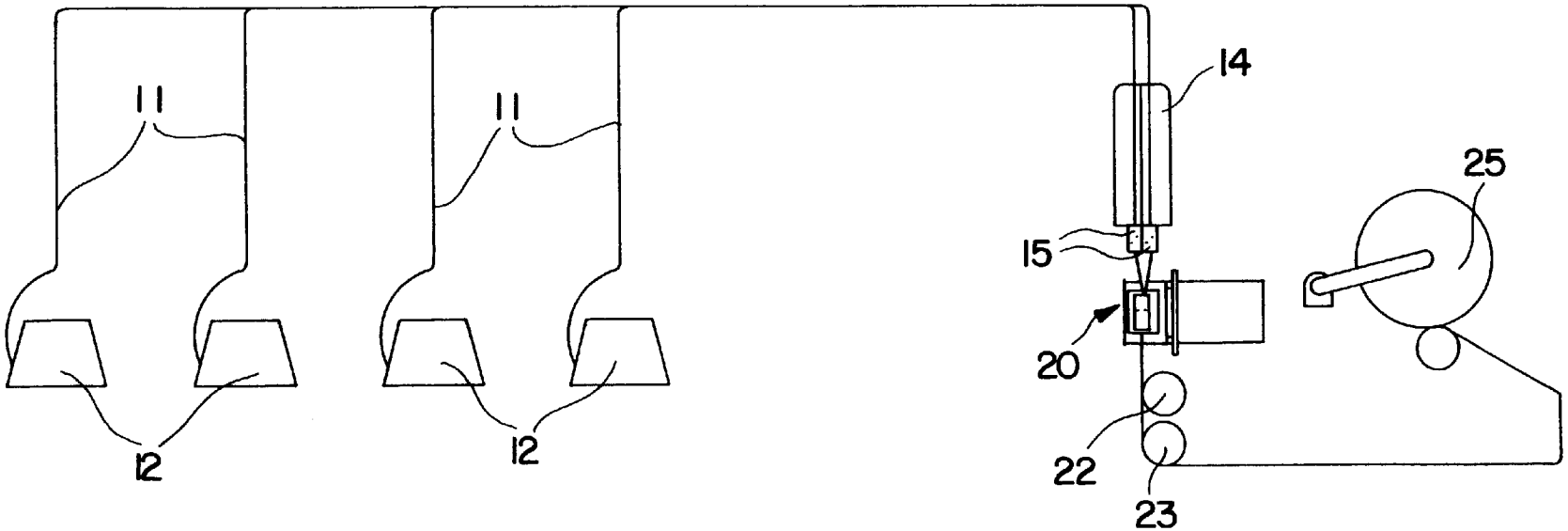
FIG. 2 is a side elevation of the embodiment of the invention shown in FIG. 1.

FIG. 2 shows the same fluid-jet false-twist apparatus 10 schematically in side elevation.

In commercial production, a predetermined number of the fluid-jet false-twist apparatuses 10 will be positioned on a single frame for simultaneous operation. The number of units 10 on a single frame may be similar to the number of units on, for example, a winder.

Figure 3:
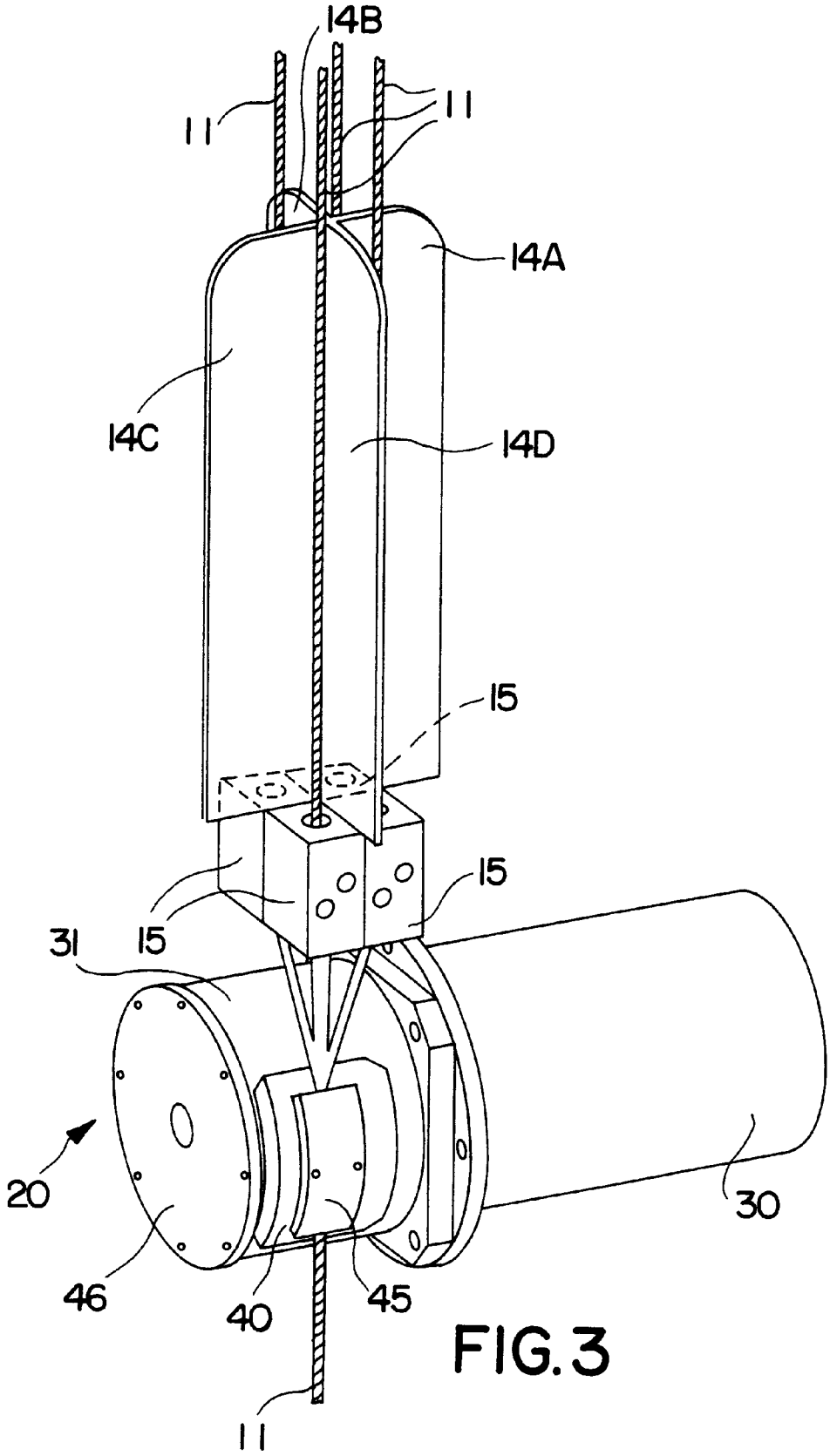
FIG. 3 shows in a close-up the twisting process according to an embodiment of the invention wherein four yarns are false-twisted.

Referring now to FIG. 3, the yarn separator 14 has four elongate, vertically-oriented wings 14A–14D. The wings 14A–14D separate the yarn path into four physically-separate zones and thereby keep the individual yarns 11 from touching and twisting together prior to passage into the twister blocks 15. As shown in FIG. 3, the yarns 11 above the twister blocks 15 are twisted in a Z-direction; the yarns 11 between the twister blocks 15 and the rotary air-jet assembly 20 are twisted in S-direction; and the plied yarn 11 below the rotary air-jet assembly 20 are twisted in Z-direction. Sufficient yarn length is needed upstream of the twister blocks 15 for the backed-up twist to accumulate.

Figure 4:
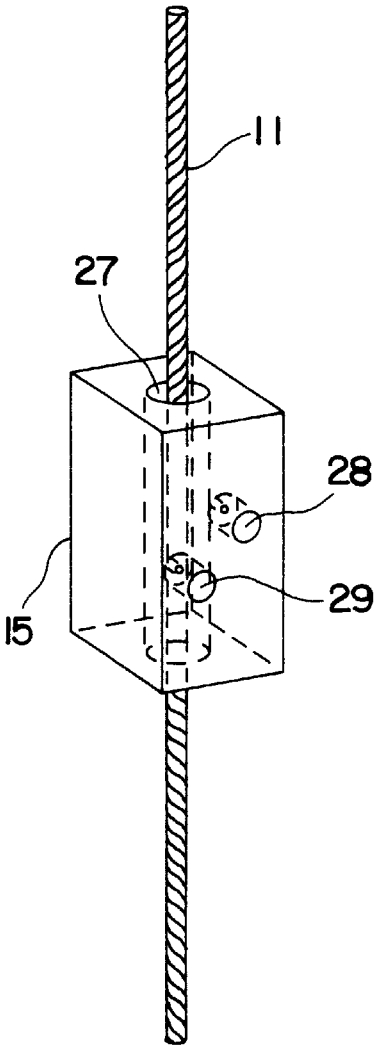
FIG. 4 shows in perspective view the air operated twister block.
Figure 5:
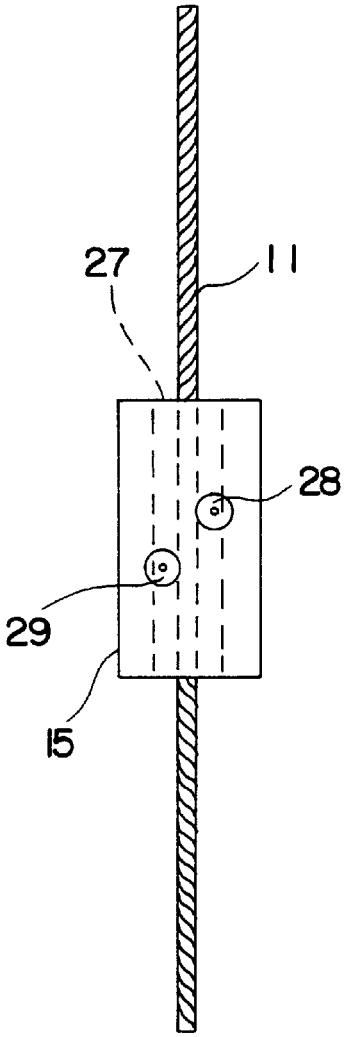
FIG. 5 shows in front view the air operated twister block.

Referring now to FIGS. 4 and 5, each of the twister blocks 15 has a vertically-oriented bore 27 through which a respective yarn 11 passes. Each of the twister blocks 15 also has two air ducts 28, 29 which communicate with the bore 27 for communicating air flow. As is shown, the axes of respective ducts 28, 29 are laterally offset with respect to the axis of the bore 27. Therefore, one of the ducts 28, 29 supplies pressurized air which is laterally offset with respect to the axis of the yarn 11 passing through the bore 27 and impinges on the moving yarn 11 in such manner that the air in one of the ducts 28, 29 creates clockwise twist in the yarn 11 and the air in the other of the ducts 28, 29 creates counterclockwise twist.

In FIGS. 4 and 5, the twister block 15 is shown with pressurized air being injected into duct 29 to insert twist in a clockwise manner, with the result that the yarn 11 above the twister block 15 has Z-twist and the yarn 11 below the twister block 15 has S-twist.

Figure 6:
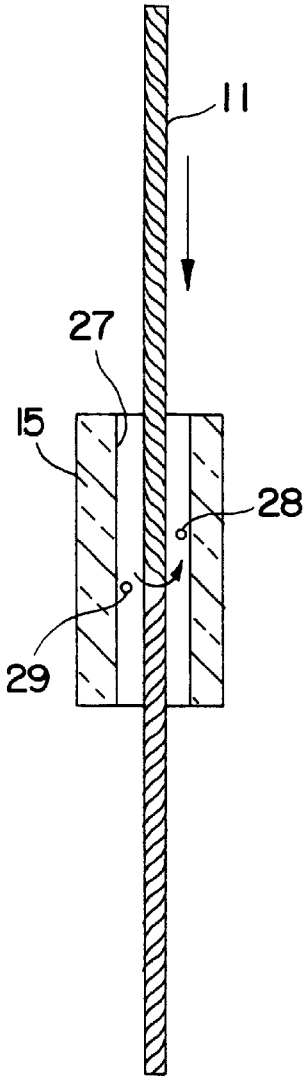
FIG. 6 is a side elevation in vertical cross-section of the twist-inserting air ducts for S-twist above and Z-twist below the twisting block.
Figure 7:
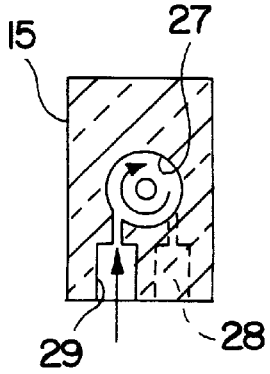
FIG. 7 is a horizontal cross-section of the twister block shown in FIG. 6.

FIG. 6 shows twister block 15 in vertical cross-section, and FIG. 7 shows a cross-section of the twister block 15 viewed from the bottom, again showing a clockwise twisting action by the air-jet generating S-twist in yarn 11 above the twister block 15 and Z-twist in the yarn 11 below the twister block 15.

Figure 8:
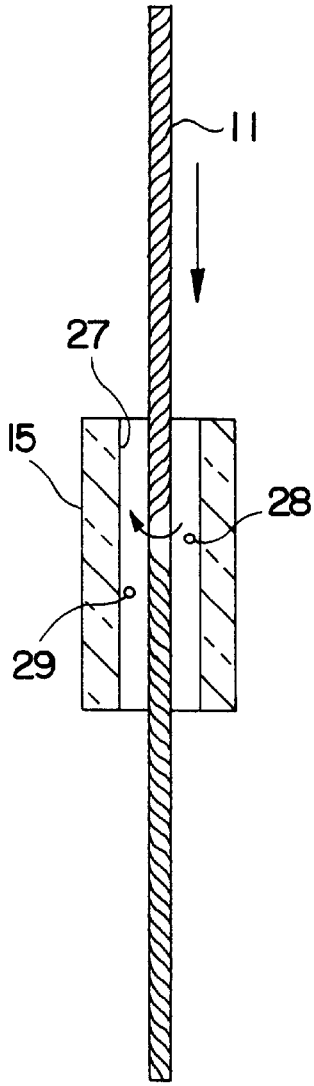
FIG. 8 illustrates the twist-inserting air ducts for Z-twist above and S-twist below the twisting nozzle.
Figure 9:
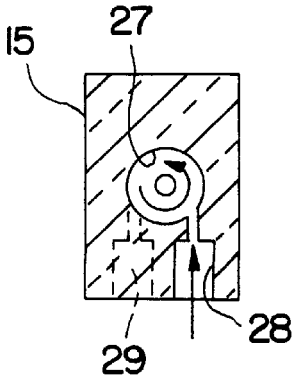
FIG. 9 is a horizontal cross-section of the twister block shown in FIG. 8.

FIG. 8 shows a twister block 15 in vertical cross-section, and FIG. 9 shows a cross-section of the same twister block 15 viewed from the bottom. As shown, counterclockwise twist generates Z-twist in yarn 11 above the twister block 15 and S-twist in the yarn 15 below the twister block 15. As noted above, four of these twister blocks 15 are grouped to receive respective yarns 11 as delivered from the upstream supply packages 12. See FIGS. 1 and 2.

Figure 10:
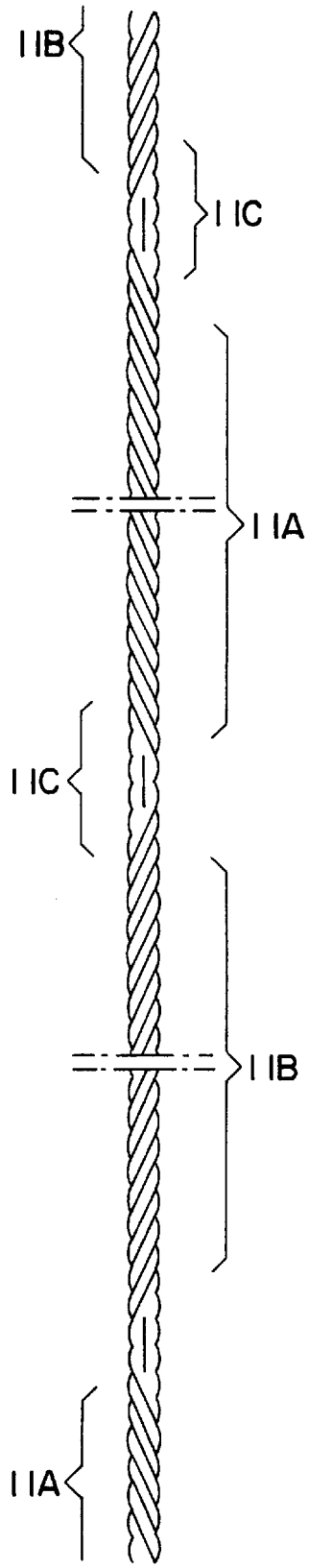
FIG. 10 is a longitudinal sectional view of a length of a plied yarn according to an embodiment of the invention.

Referring now to FIG. 10, a section of the plied yarn 11 is illustrated schematically in further detail. The plied yarn 11 is comprised of a "S"-twisted portion 11A, and an "Z"-twisted portion 11B separated by a twist reversal segment 11C constructed of entangled fibers in the manner described below. The spacing of these twist reversal segments 11C is a significant factor in the ultimate characteristics of the yarn. The twist in the yarns 11 is locked into the yarn in the alternate directions by the twist reversal segments 11C.

Figure 11:
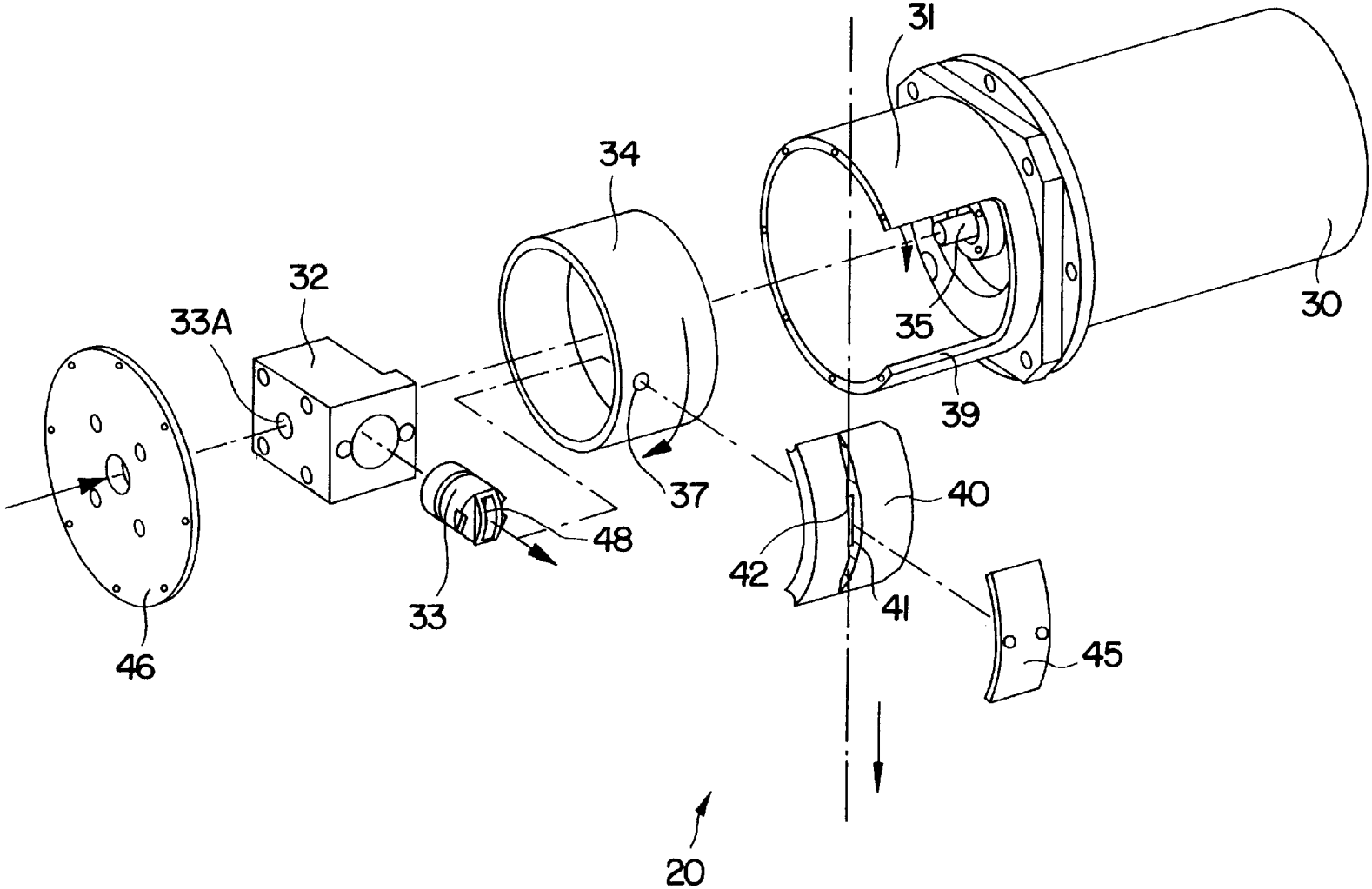
FIG. 11 is an exploded view of a rotary air-jet assembly according to an embodiment of the invention.

Referring now to FIG. 11, the rotary air-jet assembly 20 is shown in an exploded view. A drive motor 30 is mounted on the machine frame (not shown). A protective shroud 31 is positioned on one side of the motor 30 and encloses several components of the rotary air-jet assembly 20. A manifold housing 32 is mounted in shroud 31 and carries an air manifold 33 which supplies pressurized air to the rotary air-jet assembly 20. Air is supplied to the manifold by an air inlet port 33A. A rotating, cylindrical air-jet carried for rotation on the motor shaft 35 of the drive motor 30. Alternatively, the air-jet nozzle 34 may be driven by a belt, gear transmission or other suitable power transmission device. Rotating nozzle 34 is provided with an air-jet orifice 37 through which air may pass at predetermined intervals.

Shroud 31 is provided with a cut-away section 39 defined by the walls of shroud 31, into which is placed a yarn twister plate 40. Yarn guide plate 40 is provided with a vertically-oriented yarn slot 41 through which the plied yarns 11 pass after leaving the twister blocks 15. A yarn slot orifice 42 in the yarn slot 41 communicates with the air-jet nozzle 34. The yarn guide plate 40 fits over the cut-away section 39 to guide the plied yarn 11 properly past the air jet nozzle 34.

A cover 45 is positioned over the yarn slot 41 of the yarn guide plate 40 to prevent uncontrolled escape of air from the proximity of the yarn 11 and to produce in cooperation with the yarn guide plate 40 the air turbulence which entangles the yarn 11. The cover 45 has an upstream yarn entrance 45A and a downstream yarn exit 45B. An end cap 46 encloses the end of the shroud 31. Note that the air-jet nozzle 34 is the only moving part of the air-jet assembly 20 other than the shaft and associated elements of the motor 30.

Figure 12:
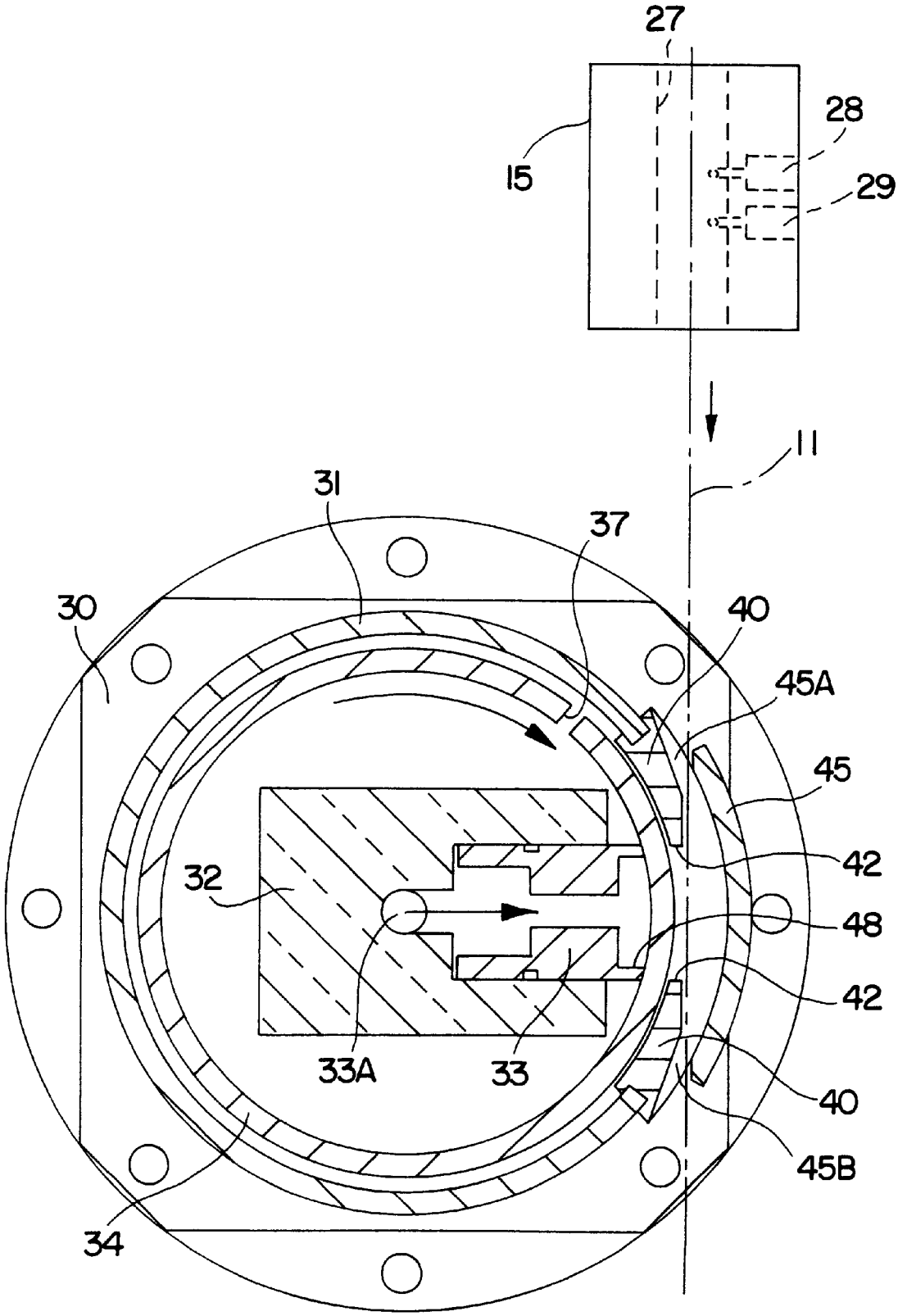
FIG. 12 is a cross-section through a rotary air-jet assembly having one air-jet orifice.

Referring now to FIG. 12, the air-jet assembly 20 is shown in vertical cross-section. Air inlet port 33A feeds pressurized air into the manifold 33. Air is ejected from the manifold through an air outlet port 48. The forward walls of the manifold 33 defining the air outlet port 48 are arcuately shaped to seal against the inside wall of rotating air-jet nozzle 34 to prevent air from escaping into the interior of the air-jet nozzle 34. As the air-jet nozzle 34 rotates, the air jet orifice 37 moves past the air outlet port 48. Each complete rotation thus creates a pulse of pressurized air which passes though the air outlet port 48, the air-jet orifice 37, the yarn slot orifice 42 and into the yarn slot 41 in the yarn guide plate 40. The distance between the air-jet nozzle 34 and the yarn guide plate 40 should be as short as possible in order to achieve a short, dense twist reversal segment 11C.

In the position shown in FIG. 12, the air-jet orifice 37 is not aligned with the yarn slot orifice 42 and thus air does not exit to the yarn slot 41, and air cannot entangle the yarn 11.

Figure 13:
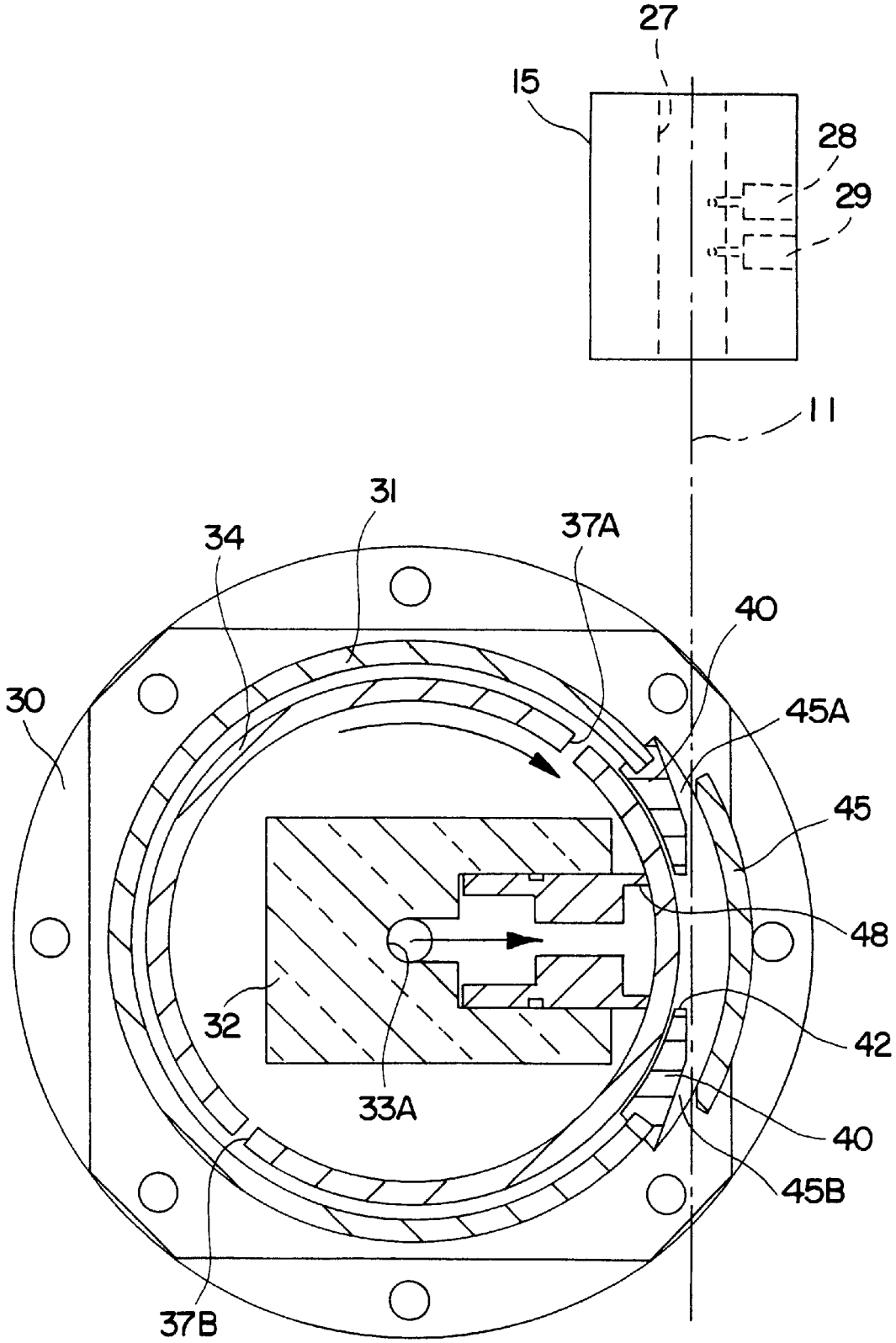
FIG. 13 is a cross-section through a rotary air-jet assembly having two air-jet orifices.

As is shown in FIG. 13, two air-jet orifices 37A and 37B can be formed in the air-jet nozzle 34, thus permitting the formation of two twist reversal segments 11C for each rotation of the air-jet nozzle 34. Other arrangements are possible, and need not be symmetrical. For example, twist reversal points which are at varying distances from each other can be created by selective placement of air-jet orifices 37 at different spacings around the circumference of the air-jet nozzle 34.

Figure 14:
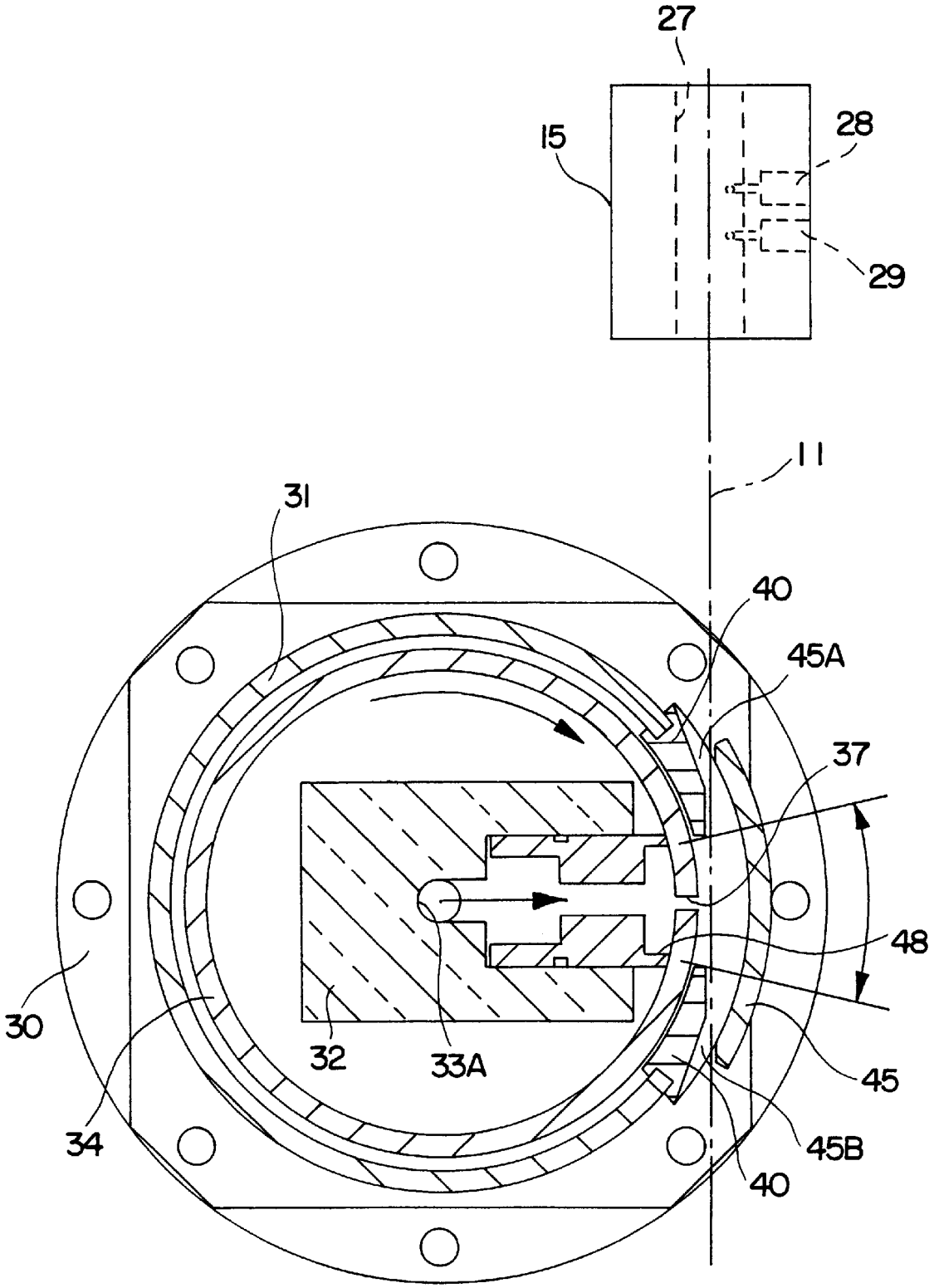
FIG. 14 is a cross-section through air-jet assembly shown in FIG. 12, with air escaping for the fiber entangling action.
Figure 15:
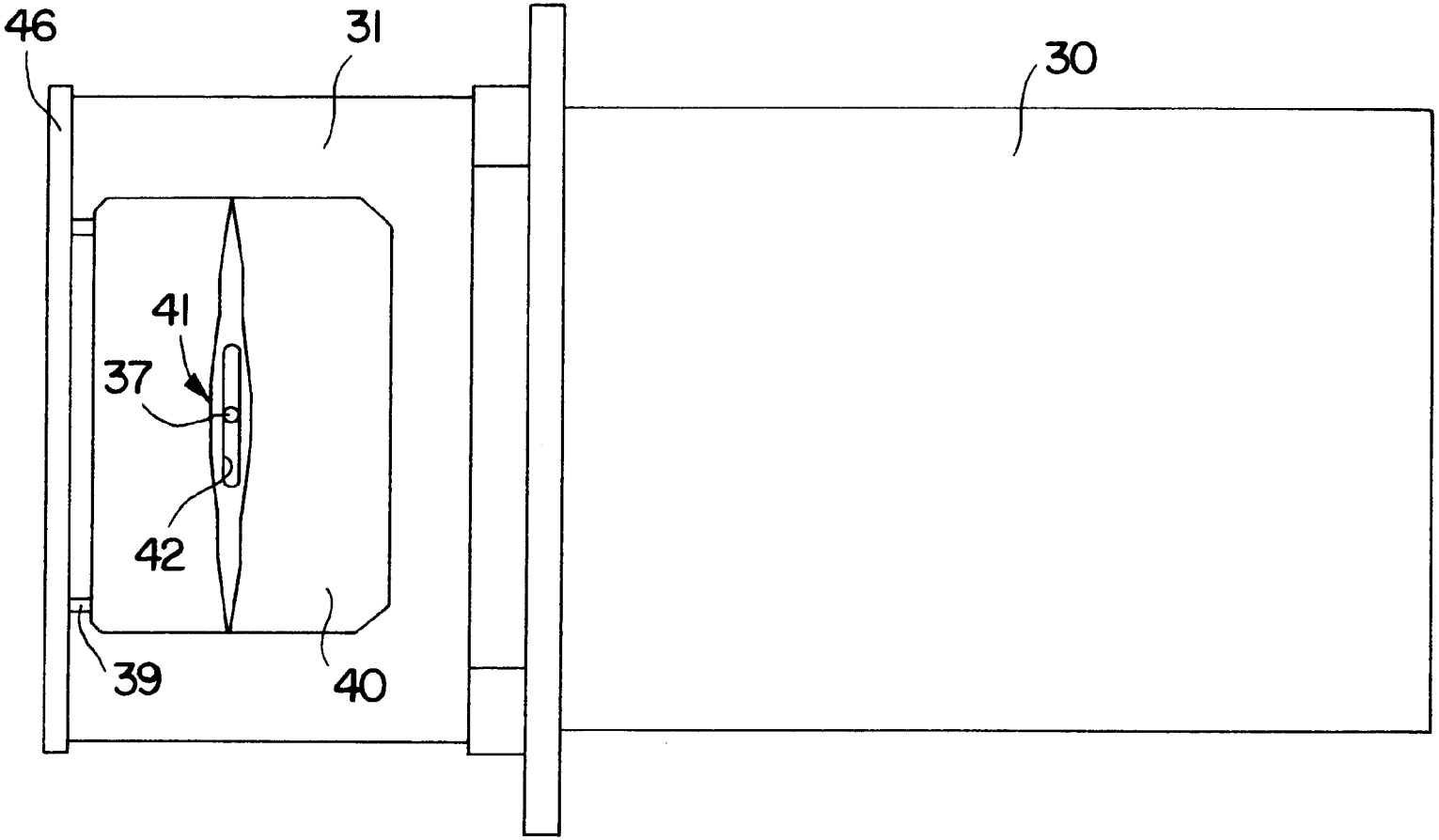
FIG. 15 shows in front view the rotating air-jet orifice in centered position.

FIGS. 14 and 15 illustrate the twist reversal formation position of the air-jet nozzle 34. The air-jet orifice 37 communicates for passage of pressurized air from the air-jet orifice 37 into the area of the yarn 11 by passing into the area of the yarn slot 41. The inside wall of the cover 45 acts as diffuser to create randomly swirling jets of high-pressure, high velocity blasts of air which pass in and through the yarn 11, tangling the yarn 11 at the point where the yarn 11 is exposed to the air blast and forming the twist reversal segments 11C.

If the yarn 11 is traveling with the same velocity as the air-jet nozzle 34, the air-jet nozzle 34 will entangle a given spot on the yarn 11 for each passage of the air-jet orifice 37 past the yarn slot 41. In this circumstance, the length of the twist reversal segment 11C should be approximately no more than the length of the yarn slot orifice 42. By increasing or decreasing the velocity of the air-jet nozzle 34 relative to the velocity of the yarn 11 through the yarn slot 41 and past the yarn slot orifice 42, the size of the twist reversal segments 11C can be controlled with a very high degree of precision.

In FIG. 15, the cover 45 is removed to show the position of the air-jet orifice 37. Note that in this view the air-jet orifice 37 is laterally centered with reference to the yarn slot orifice 42. In this position the air blast will create a generally symmetrical tangle of fibers in the yarn 11—neither favoring the Z-twist or S-twist direction.

Figure 16:
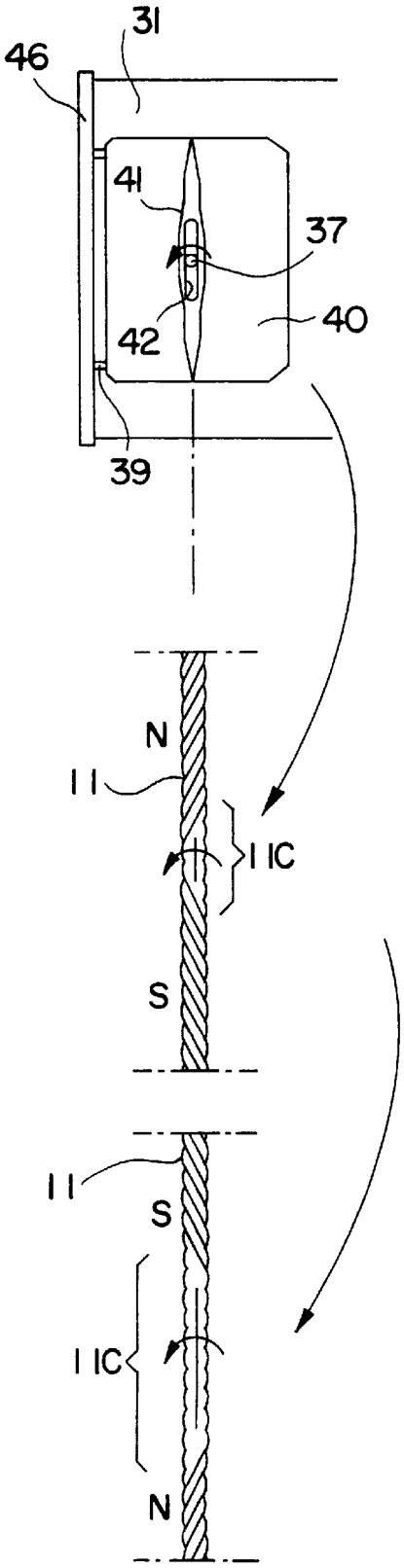
FIG. 16 shows in front view the air-jet orifice in an off-centered position with its effect on the two different yarn reversals.

In FIG. 16 (top section) the air-jet opening has been laterally shifted to the right in relation to the yarn slot orifice 42. The result of this displacement of the air-jet orifice 37 is that the air blast helps the self-twisting action of the plied yarn 11 when it changes from Z-twist to S-twist, resulting in a very short twist reversal segment 11C. See middle section of FIG. 16.

However, if the plied yarn 11 changes from S-twist to Z-twist the off-center air-jet orifice 37 partially untwists the plied yarn 11, resulting in a longer twist reversal segment 11C of lower twist. See bottom section of FIG. 16.

Figure 17:
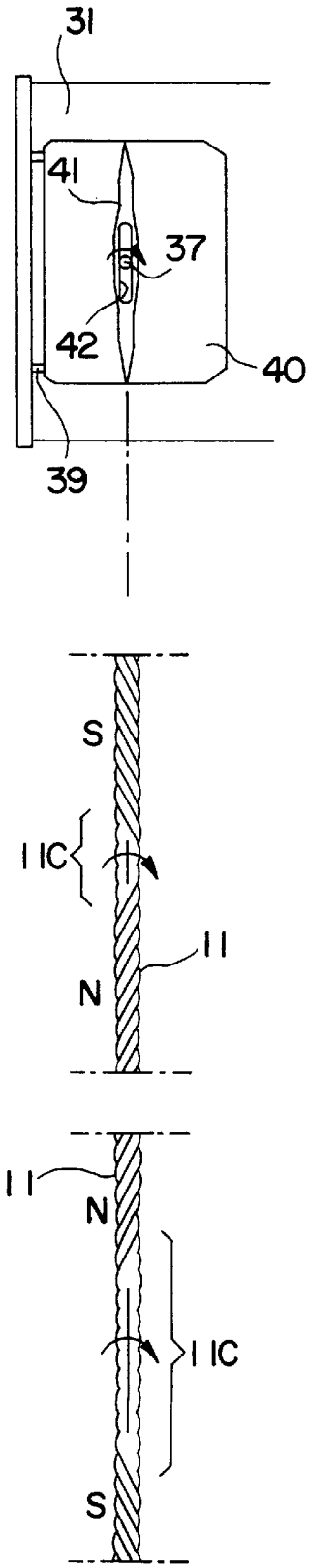
FIG. 17 shows in front view the air-jet orifice in an off-centered position toward an off-centered position opposite that in FIG. 16, with its effect on the two different yarn reversals.

FIG. 17 shows how the opposite occurs when the air-jet orifice 37 is moved laterally off center to the left. The proper arrangement for a short point of twist reversal is to use an air jet nozzle 34 with two air-jet orifices 37A and 37B (FIG. 13) where one air-jet orifice 37A or 37B is laterally offset to the right of the yarn slot orifice 42 to entangle the plied yarn 11 when the twist changes from "Z" to "S"; and use the other of the air-jet orifices 37A or 37B, which is offset to the inside of the yarn slot orifice 42, to entangle the plied yarn 11 when the twist changes from "S" to "Z".

Figure 18:
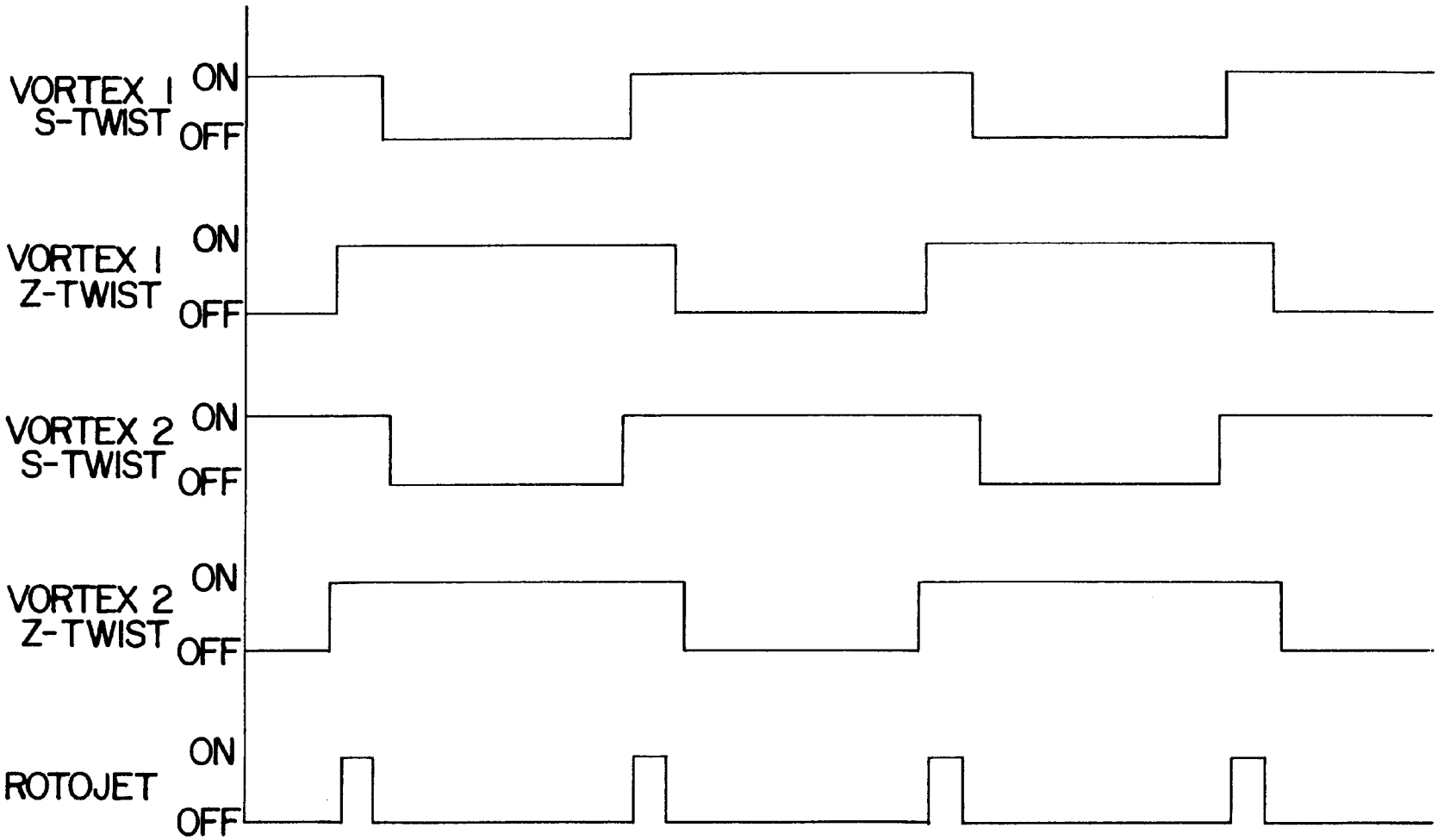
FIG. 18 is a timing diagram of the input and output of the electronic controller for an air-jet nozzle having one air-jet orifice.

Referring now to FIG. 18, the table illustrates that the active air-blast time of the rotary air-jet assembly 20 is used to time the "on" and "off" time of the twister blocks 15 for a air-jet nozzle 34 with a single air-jet orifice 37. It should be noted that the air to the "Vortex 2" ("Z-twist") twister block 15 is turned on before the air for the "Vortex 2" ("S-twist") twister block 15 is turned off. This is accomplished through electronic timing. The same type of timing is also used for the "Vortex 1" (S-twist) and Vortex 2 (Z-twist) twister blocks 15. This overlapping timing can be used if desired to achieve a short as possible twist reversal segment 11C in the plied yarn 11 since there is some unavoidable delay in the time from when the solenoid is switched on until the air is fully active in the twister blocks 15.

Figure 19:
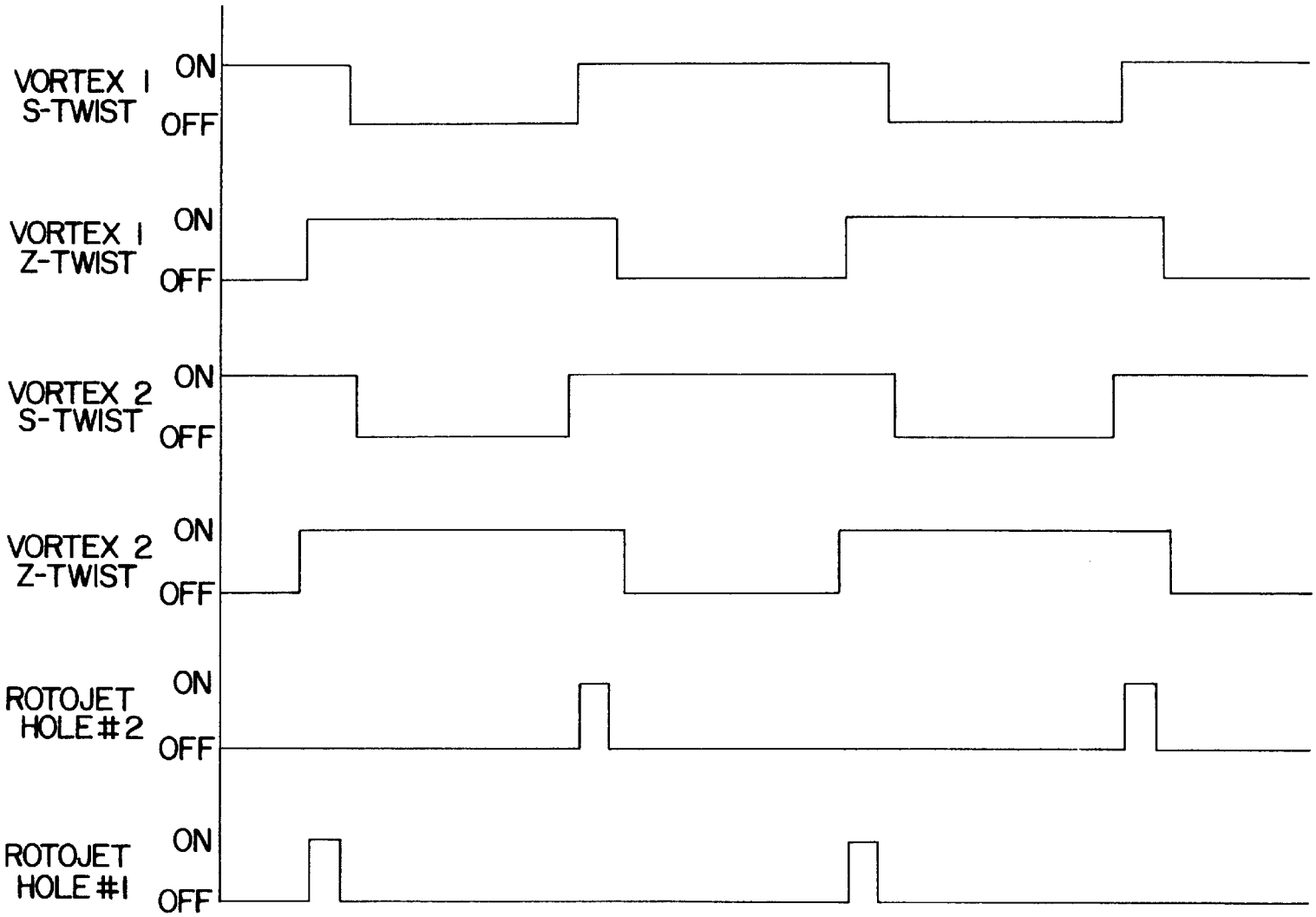
FIG. 19 is a timing diagram of the input and output of the electronic controller for an air-jet nozzle having two air-jet orifices.

FIG. 19 shows the timing for a rotary air-jet assembly 20 with an air-jet nozzle 34 having the two circumferentially-offset air-jet orifices 37A and 37B (FIG. 13) where the two air-jet orifices 37A and 37B are laterally offset to each other and are laterally displaced from the center of the yarn slot orifice 42 to accomplish a short twist reversal segment 11C.

Figure 20:
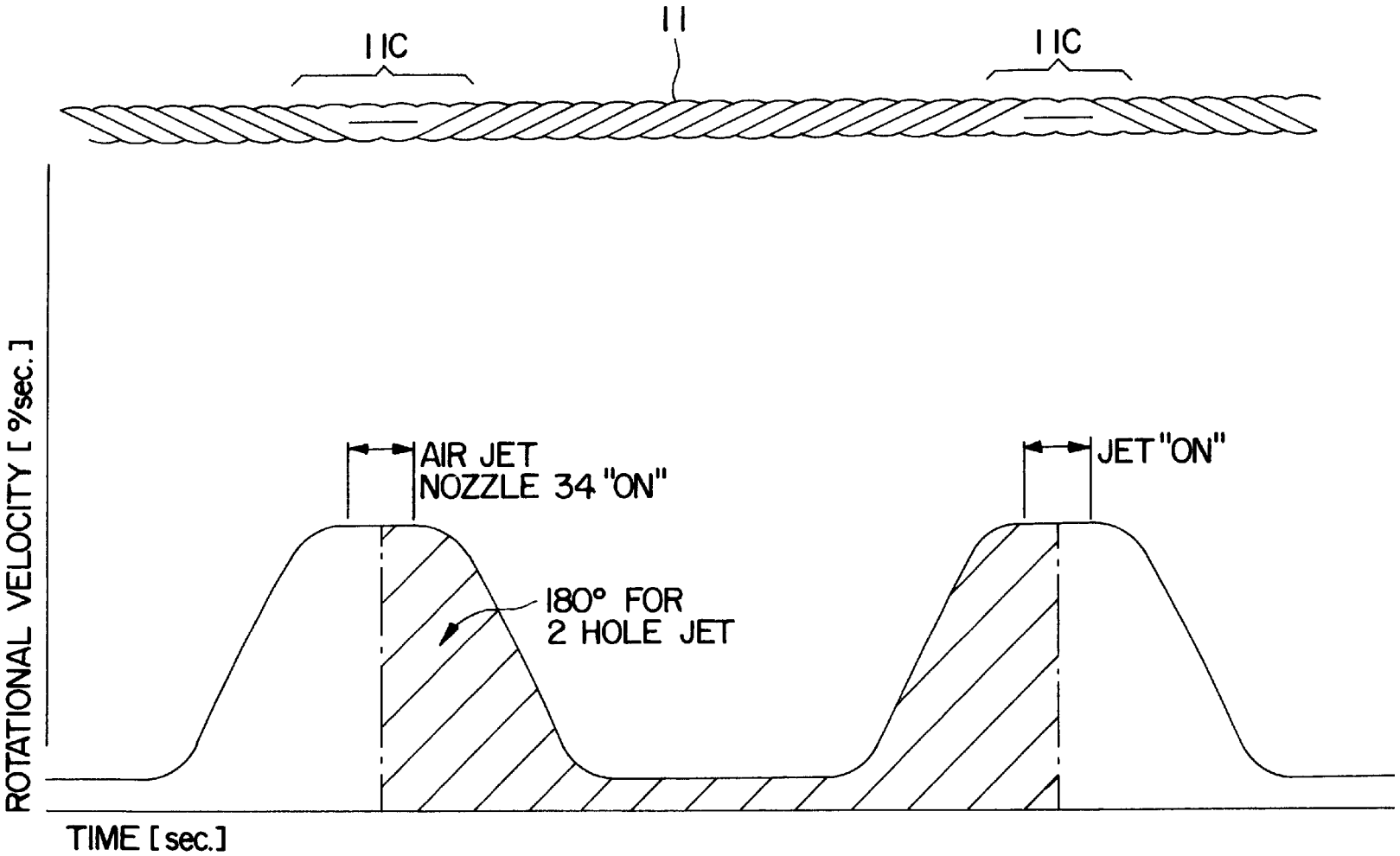
FIG. 20 is a chart showing the timing of the air-jet orifice in relation of the point of twist reversal in the processed yarn.

The timing diagram in FIG. 20 shows how the rotational speed of the rotary air-jet assembly 20 is controlled. An electronic drive (not shown) for the rotary air-jet assembly 20 is programmed in such a manner that the air-jet orifice 37 reaches the velocity of the traveling plied yarn 11 during the time that entangling of the yarn 11 is taking place. The rotational speed of the air-jet nozzle 34 with its air-jet orifice 37 is slowed down between each splicing cycle in order to wait for the next twist-reversal, at which time it has been brought up speed to match the velocity of the plied yarn 11.

The desired yarn-length between the twist reversal segments 11C and the processing speed of the yarn 11 dictates the velocity profile of the rotary air-jet assembly 20. The relationship of the rotary air-jet assembly 20 in relation to the plied yarn 11 is given in FIG. 20. The rotational velocity of the air-jet nozzle 34 is timed in two basic ways:

First, the air blast from the air-jet orifice 37 is timed to coincide with the passing of the point where the twist reversal segment 11C of the yarn 11 is to be formed. Secondly, the rotational speed of the air jet nozzle 34 matches the velocity of the traveling yarn 11 in order that the air blast is, relatively speaking, stationary with the point of creation of the twist reversal segment 11C during the entangling process. The shaded area shown below the rotational velocity line in FIG. 20 is the integral of the rotational velocity and the process time and is equal to the angular distance between two air-jet orifices 37A and 37B of the rotary air-jet assembly 20 shown in FIG. 13. The electronic controller for the drive motor 30 of the rotary air-jet assembly 20 is not shown, but may be a known angular encoder on the drive motor 30. It is naturally understood that the distance between the twist reversal segments 11C can be changed through the electronic controller, which will automatically adjust the speed of the drive motor 30 and hence of the air-jet nozzle 34 to match the requirements of the system to cause tangling of the yarn 11 at the desired points of twist reversal, and matching of the velocity of the air-net nozzle 34 with the velocity of the traveling yarn 11.

Alternatively, the electronic control of the rotary air-jet assembly 20 may be by an encoder on the drive of the take-up winder 25 (FIG. 1), which is then used as the master input for the electronic control, and from which the location of the point of twist reversal and the point where the yarn 11 is entangled is determined.

Other variations are also possible, including controlling each of several rotary air-jet assemblies 20 independently by utilizing different reversal timing, by preventing air to one or more air-jet orifices 37 for a given time, or by having an opposite twist action take place in one or more of the air-jet nozzles 34.

Figure 21:
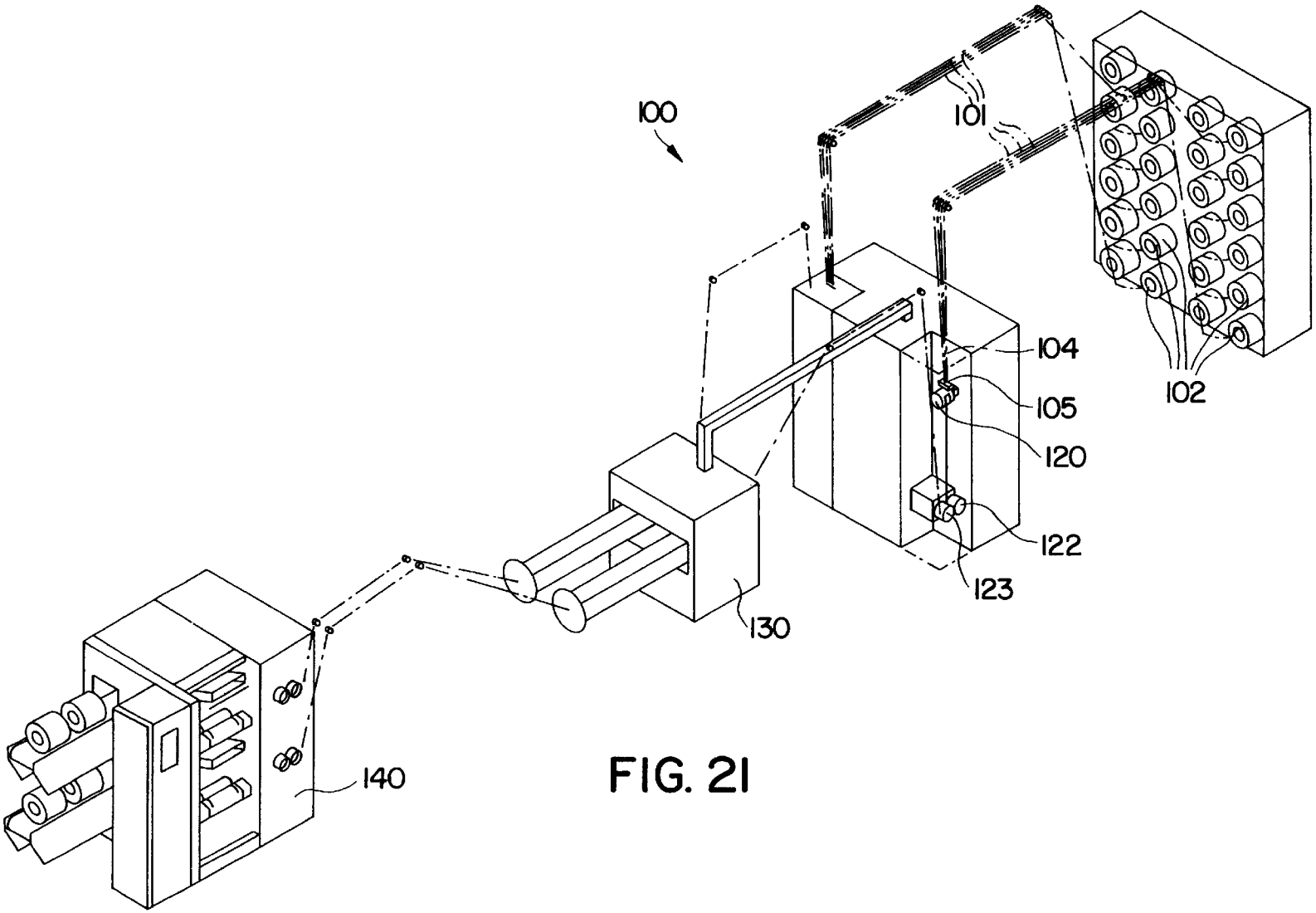
FIG. 21 is a simplified, schematic, perspective view of a fluid-jet false-twisting apparatus according to another embodiment of the present invention

Referring now to FIG. 21, a fluid-jet false-twisting apparatus according to another embodiment of the invention is shown and generally indicated at broad reference numeral 100. In general, multi-filament yarns 101 are taken from respective supply packages 102 and passed through a yarn separator 104, four twist-inserting air-jets, referred to as "twister blocks 105" (one for each yarn 101) and a rotary air jet assembly 120, where the yarns 101 are plied by the combined action of the twister blocks 105 and the rotary air jet assembly 120 in the manner described above in relation to FIGS. 1–20. Air is supplied to the twister blocks 105 from a source of pressurized air by means of solenoid valves controlled by mechanical, electromechanical or, preferably, electronic means (not shown).

The yarns 101, now in plied form, are guided around overfeed drive rolls 122, 123 where the tension on the plied yarns 101 is reduced to a predetermined extent before delivery to a yarn accumulator 130 and to a downstream take-up winder 140. The yarn accumulator may be a Belmont Model AC-50 accumulator, and the winder may be a Model AD-25 take-up winder. The yarn accumulator 130 helps buffer variations in yarn tension, and permits the system to continue operating during package changes. In addition, any lengths of defective yarn can easily be seen in the accumulator and removed during machine operation. The accumulator 130 may act as the "master encoder" for purposes of determining actuation of the various twist inserting and entangling functions described above.

Alternatively, the overfeed drive rolls 122, 123 may be removed and replace with a nip roll (not shown), in which case the nip rolls may be used as the constant speed master off of which the other functions of the fluid-jet false-twisting apparatus 100 are timed.

An apparatus and method for twisting individual strands of yarn and plying these individually twisted strands around each other is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A process of producing an assembled yarn, comprising the steps of:

(a) moving at least two yarns along a yarn path downstream from a supply to a take-up;

(b) inserting alternating-direction zones of twist into at least one of the yarns, said at least one yarn having an area of zero twist between said alternating direction zones of twist;

(c) combining the at least two yarns to form a single, integrated yarn strand;

(d) intermittently exposing the yarn strand to a moving air blast to create a zone of intermingled yarns at each area of zero twist of the yarn strand to prevent torsional movement of one yarn relative to the other yarn, wherein;

(i) the air blast is moved at a first predetermined rate of speed along the direction of travel of the yarn strand as the yarns are intermingled at the areas of zero twist to thereby reduce the length of the zone of intermingled yarns; and (ii) the air blast is moved at a second predetermined rate of speed less than the first rate of speed between the areas of zero twist sufficient to permit a predetermined distance between zones of intermingled yarns.

2. A process according to claim 1, wherein the step of exposing the yarn to an air blast includes the steps of:

(a) intermingling the yarns at the areas of zero twist; and (b) intermingling the yarns at spaced-apart points along the length of the yarn strand other than at the areas of zero twist.

3. A process according to claim 1, wherein the step of exposing the yarn to an air blast includes the step of intermingling the yarns at random points along the length of the yarn strand.

4. A process according to claim 1, wherein the step of exposing the yarn to an air blast includes the step of intermingling the yarns at predetermined points along the length of the yarn strand.

5. A process according to claim 1, wherein the step of exposing the yarn to an air blast includes the steps of:

(a) intermingling the yarns at random points along the length of the yarn strand; and (b) intermingling the yarns at predetermined points along the length of the yarn strand.

6. A process according to claim 1, wherein the step of inserting alternating-direction zones of twist into at least one of the yarns comprises applying an air blast-induced torque to said yarn.

7. A process according to claim 1, wherein the step of moving the air blast at the first predetermined rate of speed includes the step of moving the air blast at a linear speed equal to the linear speed of travel of the yarn strand.

8. A process according to claim 1, wherein the step of moving the air blast at the first predetermined rate of speed includes the step of moving the air blast at a linear speed not equal to the linear speed of travel of the yarn strand.

9. A process according to claim 1, wherein the step of inserting alternating-direction zones of twist into at least one of the yarns comprising the step of inserting more turns of twist per unit length of yarn in one direction than in the other direction.

10. A process according to claim 1, wherein the step of inserting alternating-direction zones of twist comprises the step of changing the direction of twist in fewer than all the yarns at a given time.

11. A process according to claim 1, wherein the step of intermittently exposing the yarn strand to a moving air blast to create a zone of intermingled yarns comprises the steps of:

(a) providing an enclosure having an orifice directed at the yarn path;

(b) providing an air-jet nozzle within the enclosure for directing the air blast through the orifice; and (c) intermittently directing the air blast through the orifice into the yarn path.

12. A process according to claim 11, wherein the step of intermittently directing the air blast through the orifice includes the step of rotating the air-jet nozzle in said enclosure intermittently past the orifice.

* * * * *